United States Patent [19]

Treitz

[11] 4,228,872

[45] Oct. 21, 1980

[54] LADDER

[76] Inventor: Gerd Treitz, Conollystr. 19, 8000 Müchen 40, Fed. Rep. of Germany

[21] Appl. No.: 75,581

[22] Filed: Sep. 14, 1979

[30] Foreign Application Priority Data

Sep. 15, 1978 [DE] Fed. Rep. of Germany ..... 2840266

[51] Int. Cl.[3] ..... E06C 1/38

[52] U.S. Cl. ..... 182/194; 182/228; 113/116 V

[58] Field of Search ..... 182/194, 228; 113/116 V, 116 R; 52/191

[56] References Cited

U.S. PATENT DOCUMENTS

| | | | |
|---|---|---|---|
| 1,196,667 | 8/1916 | Dallmeyer | 182/194 |
| 1,688,210 | 10/1928 | Smith | 182/194 |
| 1,714,451 | 5/1929 | Sauvage | 182/194 |
| 3,299,985 | 1/1967 | Harrison | 182/194 |
| 3,908,260 | 9/1975 | Loomis | 113/116 R |

*Primary Examiner*—Reinaldo P. Machado
*Attorney, Agent, or Firm*—Hill, Van Santen, Steadman, Chiara & Simpson

[57] ABSTRACT

To enable use to be made of relatively thin sheet metal to be employed in the manufacture of a ladder which is formed by punching adjacent openings from the sheet to leave edge strips which are subsequently folded to form stiles and cross pieces which are twisted to form tread bodies, embossed corrugations are incorporated into the twisted metal portions between the tread bodies and the stiles, and stiffening cheeks along the edges of the tread bodies are folded below the said bodies, thereby to impart rigidity to the ladder structure. Additionally or alternatively, holes and/or further corrugations may be provided, and the stiles may, if desired, be of oval cross-section each with connecting cheeks along their facing edges.

11 Claims, 5 Drawing Figures

LADDER

BACKGROUND OF THE INVENTION

This invention relates to a ladder (which may be a step ladder) of which the stiles and the steps are provided by a single-piece coherent metal sheet which is divided between the individual steps, transversely to the stiles, and in which, furthermore, the steps are twisted out of the plane of the metal sheet, the twisted portions having a lesser depth than the depth of the step and the stiles are formed by profiling of the flat material.

Such a ladder is already known from German Offenlegungsschrift No. 2404108. When using this ladder it becomes evident that, in order to achieve the necessary torsional rigidity and strength, disporportionately strong or thick sheet metal has to be used, which in turn means that there has to be a very high investment expenditure for the heavy machines necessary for production of the ladder. Furthermore, the ladders produced from the thick sheet material become very heavy, so that they are generally suitable only for stationary use.

However, the need exists of producing ladders which are light in weight and suitable for mobile use, similarly from a single-piece metal sheet, by the use of comparatively thin metal sheet or light metal sheet.

OBJECT OF THE INVENTION

The problem underlying the invention is, therefore, to develop constructionally a ladder, of the kind mentioned at the introduction hereof, in such a way that it can be produced from comparatively thin light metal sheet and nevertheless has very high bending and torsional rigidity so that it can absorb high individual loads. In this respect, it is to be ensured, in production, that all regions subjected to stretch-forming can be worked in a manner which leaves them free of fatigue and/or defect.

BRIEF STATEMENT OF THE INVENTION

In accordance with the invention, this problem is solved in that corrugations or bores are arranged in the twisted regions between the steps and the stiles and in that each step is formed by a step body which is stiffened by folding.

Substantial security against breakage is achieved by the use preferably of one bore approximately in the centre of such twisted region and/or the siting of corrugations which extend from the respective stile to the step body, in each twisted region. In this respect, the particularly advantageous embodiment consists in that a corrugation extends, in each case, from step to step along the respective stile or along a stile connection, and in that said corrugation either ends at the respective separately-stiffened step bodies or extends through each said step body to the stiffening thereof.

Advantageously, in this respect, two corrugations, extending from the adjoining stile portions into a common twisted region, extend parallel to the material edge in the twisted region.

It has also proved to be advantageous for a third corrugation, which extends approximately along the twist axis, to be arranged between the said two corrugations in the twisted region.

For achieving a stable and bending-stiff design for each step, which also ensures good load distribution upon application of individual load thereto, in a special development provision is made for the step body to comprise a tread which extends over the length and breadth of the step, and two angled stiffening cheeks which connect thereto.

With such a design, the angled stiffening cheeks are preferably folded over towards one another at the reverse side of the tread to contact one another, and are connected securely together where they contact.

A particularly advantageous design of the step body is also achieved in that the tread surface is formed from an impressed flat area having embossed holes therein, and in that the two corrugations extending out from the adjoining stile portions through the respective twisted regions and at the edge of the impressed flat area.

In order, for such a ladder, to improve further the torsional rigidity or torsional strength, and more especially also to increase lateral stability, provision may furthermore be made for the stiles each to be designed in cross-section as an oval stile, in which overlapping connecting cheeks extend along the inner side surface, and in that these connecting cheeks form stile connections for the twisted regions.

As a result of this oval stile design and the overlapping connecting cheeks which extend along each stile, any twisting of the stile profile, about the longitudinal axis, is counteracted, so that even very high individual loads, on a step body, acting eccentrically on the stile profiles, can be absorbed without substantial twisting.

As a result of the proposals of the invention, the advantageous possibility is provided of being able to produce, from a single-piece metal sheet, a ladder which is comparatively light in weight and which, nevertheless, can absorb disproportionately high loads. In the case of a ladder, incorporating the features of the invention, made of 2 mm thick aluminum sheet, the step bodies will absorb individual loads of the order of magnitude of about 250 kg, without the ladder experiencing any significant twisting and without any deformation occurring in the region of the step body or of the twisted region thereof.

BRIEF SCHEDULE OF THE DRAWINGS

Other advantages and features of the invention will become apparent from the following description of an exemplified embodiment give in conjunction with the accompanying drawings, in which.

DESCRIPTION OF THE ILLUSTRATED EMBODIMENT

Figure 1:
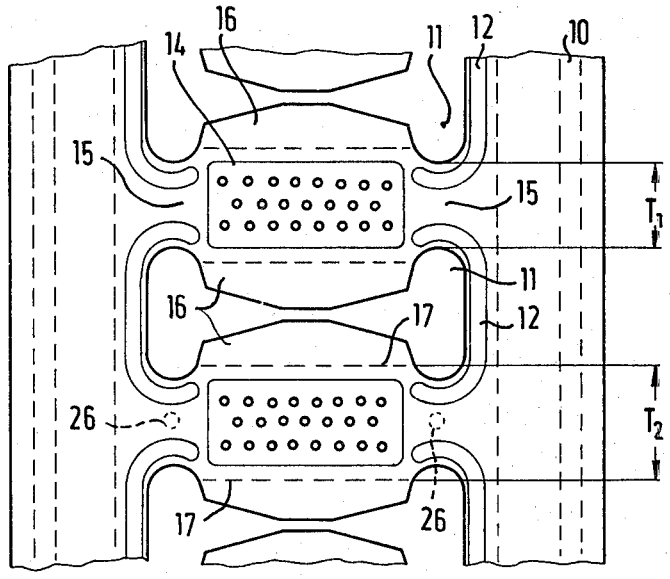
FIG. 1 is a plan view of part of a metal sheet, provided for the manufacture of a ladder conforming to the present invention, the sheet being shown in an intermediate stage of the production process.
Figure 2:
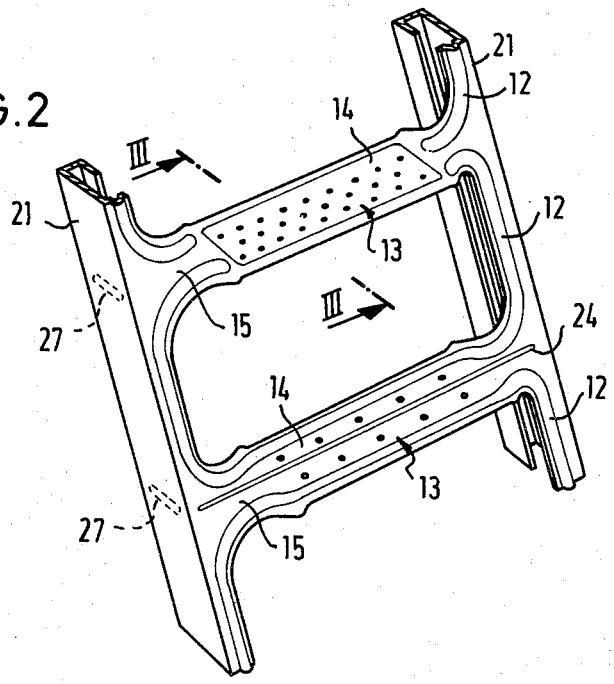
FIG. 2 is a fragmentary perspective view illustrating a finished ladder conforming to the invention, but having two differently-formed-impressed steps.
Figure 3:
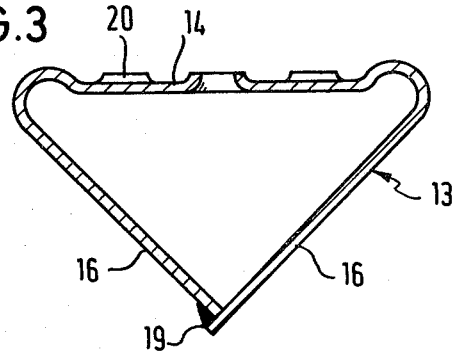
FIG. 3 is an enlarged section through one of the step bodies of the ladder of FIG. 2, taken along the line 3—3 of FIG. 2.

As shown in FIG. 1, a ladder is produced from a single-piece metal sheet 10 from which parts 11 are cut out by punching openings in such a way that by deforming or folding the residual metal sheet the ladder arises in the form shown in perspective in FIG. 2. After the parts 11 have been punched out, corrugations 12 are impressed into the material, e.g. by embossing, which corrugations 12 serve to stiffen the ladder stiles between the adjacent steps and for the stiffening of the respective twisted regions between the stiles and the steps. The connecting pieces remaining, after the punching out of the parts 11, between the edge strips, serve for the formation of the step bodies 13, as shown in FIG. 2. Each such connecting piece provides the material parts for a tread surface 14, respective twisted regions 15 and respective stiffening cheeks 16. Upon the production of each step body 13, the stiffening cheeks 16 thereof are angled rearwardly along a line 17 and, in the case of the embodiment of the step body 13 as shown in section in FIG. 3, are folded over towards one another to such an extent that they touch along a contact line 19. In the region of this contact line 19, the stiffening cheeks can be interengaged with one another or, as shown in FIGS. 3 and 4, can be welded together.

In the case of the step body 13 shown in section in FIG. 3, the tread surface 14 is designed as an impressed area in which upwardly-open embossed holes 20 are situated, which holes 20 undertake the function of providing an anti-slip thread surface. Instead of the embossed holes, a non-slip insert may be provided in the region of the impressed area.

Figure 4:
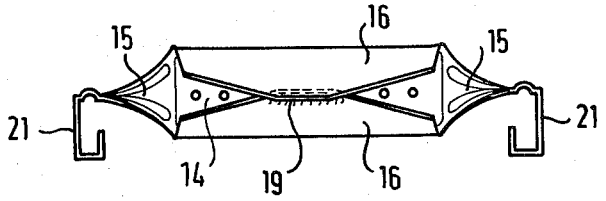
FIG. 4 is a view of the completed ladder from below.

To fashion the stiles 21, the edge strips of the single-piece metal sheet 10 are folded several times and, in the embodiment of FIGS. 2 and 4, are each shaped into a rectangular or box-like profile. For this, preferably use is made of a strip profiling mechanism, in which the bending is effected with the aid of rollers.

Figure 5:
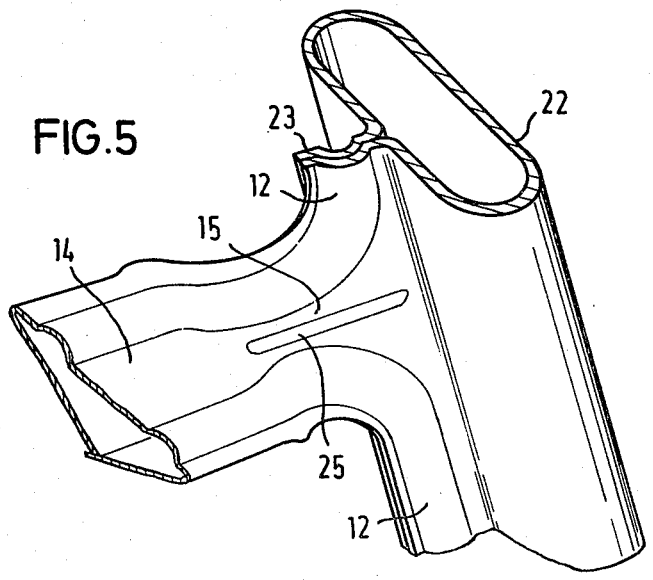
FIG. 5 is an enlarged fragmentary perspective view of a twisted region of one of the steps of a second embodiment of the ladder of the invention, in which the stiles are oval in cross-section.

In the embodiment of FIG. 5, the edge strips of the single-piece metal sheet 10 have been deformed each into a stile 22 of oval cross-section with a respective connecting cheek 23 extending along each said stile. The connecting cheeks 13 constitute stile connections for the step body, into which the corrugations 12 can also extend, thus contributing considerably to increasing torsional rigidity of the finished ladder. Adequate torsional rigidity is necessary in this region because the step bodies are fastened eccentrically to the stile profile and, upon a loading of each step body, the stile profiles have a tendency to warp about the longitudinal axes thereof.

The perspective representation of the ladder in accordance with FIG. 2 shows two different embodiments for the step body. The embodiment shown in the upper part of the figure has a tread surface formed by an impressed area, whereby a rib-like edge stiffening results and at the same time the corrugations 12 extend only as far as this rib-like edge stiffening. In the case of the embodiment shown in the lower part of the figure, the corrugations 12 merge into the rib-like edge stiffening and extend over the entire width of the step. Furthermore, a central corrugation 24 is provided which extends, in the region of the twist axis, through the twisted region 15 and through the centre of the tread surface. In a corresponding way the corrugation course is shown in the embodiment of FIG. 5, but, instead of there being a central corrugation, a short corrugation 25 is provided which extends solely in the region of the twist axis through the twisted region 15. Instead of this short corrugation, a bore 26 may be used, as is indicated in broken lines in FIG. 1.

Upon the production of the ladder, after the completion of the stiles 21, 22 and completion of the step bodies 13, the latter are twisted, into the intended angular dispositions relative to the stiles, out of the original plane of the single-piece metal sheet 10. This twisting is effected in the twisted region 15, in which respect, as a result of the presence of the corrugations and/or the use of the bores 26, it is ensured that the stretch-forming or deformation in the twist region can be carried out in a tear- and break-free manner. Through the combination of the corrugations or of the corrugations and bores, it is ensured that the multi-axis tensions which arise during the stretch-forming do not lead to any tearing or breaking of the material in the twisted region. It has been shown that corrugations situated in the twisted region, as compared with one or more bores, lead to greater stiffness of the ladder.

When using comparatively thin sheets, it may be advantageous, for increasing the stiffness of the stiles and in order to prevent buckling of the stile web, if a further corrugation is situated in the axis of each step in the respective stile webs. Finally, also, notches (not shown in the drawings) can be situated in the region of the twisting at the front outer edge of each stile, which notches counteract any deflection of the step about the twist axis during use.

The shaping, as well as the course of the corrugations, and the arrangement thereof, depends most extensively or very largely on the demands to be made on the ladder with regard to torsional rigidity or bending rigidity. According, also the depth $T_1$ of the twisted region can be coordinated to the depth $T_2$ of the step. The magnitudes of these values depends also on the thickness of the metal sheet being used.

With the aid of the measures described above, for example from a single-piece aluminium sheet having a thickness of about 1.5 to 2 mm, a ladder can be produced which, with regard to torsional rigidity and bending rigidity, fulfils all operational demands including customary safety requirements. Even in the event of high individual loading of the steps, the stair tread construction ensures a very good load distribution.

I claim:

1. A ladder comprising a pair of spaced-apart stiles, and a plurality of steps extending between said stiles, said stiles and steps being provided by a one-piece coherent metal sheet divided between the individual said steps, transversely to said stiles to define step bodies which are twisted out of the plane of said metal sheet to form said steps, each said twisted portion having a lesser depth than the step depth, and said stiles being formed by profiling of the flat sheet material, characterised by the provision, in the twisted regions between each said step and said stiles, of formations selected from corrugations and holes, and in that each said step body is stiffened by folding.

2. A ladder as set forth in claim 1, characterised in that a respective said hole is situated approximately in the centre of each said twisted region.

3. A ladder as set forth in claim 1 characterised in that respective said corrugations, extending from the respective said stile to the respective step body, are situated in each said twisted region.

4. A ladder as set forth in claim 3, characterised in that a respective said corrugation extends, in each case, from each said step to the next adjacent said step along the respective stile or a connection thereto, and in that said corrugation either ends at the respective separately-stiffened step bodies or extends through each said step body to the stiffening thereof.

5. A ladder as set forth in claim 3 characterised in that two said corrugations, extending from adjoining said stile portions into a common said twisted region extend parallel to the material edge in said twisted region.

6. A ladder as set forth in claim 5, characterised in that a third said corrugation, which extends approximately along the twist axis, is arranged between the said two corrugations in said twisted region.

7. A ladder as set forth in claim 1, characterised in that each said step body comprises a tread which extends over the length and breadth of the respective said step as well as two angled stiffening cheeks which connect thereto.

8. A ladder as set forth in claim 7, characterised in that said angled stiffening cheeks are folded over towards one another at the reverse side of said tread to contact one another, and in that said stiffening cheeks are connected securely together where they contact.

9. A ladder as set forth in claim 8, characterised in that said stiffening cheeks abut approximately at right angles where they contact one another.

10. A ladder as claimed in claim 4, characterised in that each said tread surface is formed by respective impressed flat area having embossed holes therein, and in that said corrugations extending out from the adjoining portions of said stiles, through the respective said twisted regions, and at the edge of said impressed flat area.

11. A ladder as set forth in claim 1 characterised in that each said stile is designed in cross-section as an oval stile and in which overlapping connecting cheeks extend along the inner side surfaces thereof and in that these connecting cheeks form stile connections for said twisted regions.

* * * * *